United States Patent [19]

Meroth et al.

[11] Patent Number: 4,837,485

[45] Date of Patent: Jun. 6, 1989

[54] METHOD AND SYSTEM FOR STARTING A POWER LOOM

[75] Inventors: Klaus Meroth, Lindau; Dieter Wegendt-Kristyn, Lindau/Bodolz, both of Fed. Rep. of Germany

[73] Assignee: Lindauer Dornier Gesellschaft mbH, Lindau/Bondensee, Fed. Rep. of Germany

[21] Appl. No.: 136,656

[22] Filed: Dec. 22, 1987

[30] Foreign Application Priority Data

Dec. 27, 1986 [DE] Fed. Rep. of Germany ..... 3644565
Oct. 5, 1987 [DE] Fed. Rep. of Germany ..... 3733590

[51] Int. Cl.[4] ..... H02K 7/02
[52] U.S. Cl. ..... 318/161
[58] Field of Search ..... 318/136, 161, 430, 431, 318/150; 139/1 E, 97, 99, 105, 304, 309, 315, 449

[56] References Cited

U.S. PATENT DOCUMENTS 4,707,643 11/1987 Rohr et al. ..... 318/161 K
4,723,099 2/1988 Herzig ..... 318/161

FOREIGN PATENT DOCUMENTS 1535525 7/1970 Fed. Rep. of Germany .
3542650 6/1987 Fed. Rep. of Germany ..... 139/1 E
59-173342 10/1984 Japan ..... 139/1 E
60-17153 1/1985 Japan ..... 139/1 E
60-167954 8/1985 Japan ..... 139/1 E
61-124651 6/1986 Japan ..... 139/99

*Primary Examiner*—Bentsu Ro
*Attorney, Agent, or Firm*—W. G. Fasse; D. H. Kane, Jr.

[57] ABSTRACT

A power loom is started by first accelerating a flywheel mass to an r.p.m. higher than a rated operational r.p.m. of a loom drive shaft while the flywheel mass is disconnected from the loom drive shaft but connected to the loom drive motor which is operated at a higher r.p.m. than the rated operational r.p.m. Then, the flywheel mass is connected to the loom drive shaft while the loom drive motor is disconnected from its power supply so that only the energy stored in the accelerated flywheel mass accelerates the loom drive shaft to its rated r.p.m. Then, after the first beat of the reed the drive motor is electrically reconnected to its power supply for driving the loom at the rated r.p.m. The motor may be operated at a higher r.p.m. e.g., through a frequency converter or by switching a multipole motor from a higher pole number, e.g., four poles to a lower pole number, e.g. two poles, whereby the motor operation at the higher pole number with a lower r.p.m. corresponds to the rated operational r.p.m. The pole switch-over takes place with such a delay that the full higher r.p.m. is not reached.

13 Claims, 4 Drawing Sheets n
n2
n1
0
Eo
T2'
I
II
III
E1
E2
T1
t n
n2
n1
0
Eo
E1
Ex
E2
a
b
c
T2
T1
t

METHOD AND SYSTEM FOR STARTING A POWER LOOM

FIELD OF THE INVENTION

The invention relates to a method and system for starting a power loom equipped with an electrical main drive. In such a loom the start-up energy is provided primarily or substantially by electrically driven flywheel masses that can be coupled to the loom drive.

DESCRIPTION OF THE PRIOR ART

It is customary to drive power looms by electrical motors which are connected to an alternating power supply or a three-phase power supply network. The r.p.m. of the main drive motor is determined by the type of motor construction, for example, the pole number and by the frequency of the power supply network. Hereafter, reference will simply be made to "power supply". The main drive motor is coupled by power transmission means, for example, belt and pulley drives, to the main drive shaft of the loom to which flywheel masses are coupled. Prior art systems are so constructed that following the switching-on of the main drive, the flywheel mass is first accelerated by the motor to the respective r.p.m. For starting the loom itself a clutch brake unit is used for connecting the flywheel mass to the main drive shaft of the loom so that the flywheel mass starts the loom out of standstill. The performance characteristic or curve of the clutch, the stiffness or excess dimensioning of the motor, and the size of the effective flywheel masses, as well as friction resistances, determine a very specific r.p.m. characteristic of the power loom during its start-up. These start-up characteristics are to be considered separately for the flywheel masses on the one hand, and for the main drive shaft of the power loom on the other hand. Thus, the r.p.m. of the flywheel masses drops substantially subsequent to engaging the clutch. The drop of the r.p.m. of the flywheel mass continues until the flywheel mass r.p.m. is synchronous to the r.p.m. of the main drive shaft of the loom which rises from standstill.

Starting systems for looms of the type mentioned above must satisfy special conditions in practice. Thus, for example, it is necessary that the loom is completely coupled to its power drive before the first beat of the reed. It can happen in such a coupling operation of the loom drive to the loom drive shaft that the coupling is completed on time, while the instantaneous rotational speed of the loom is too small at the first beat of the reed so that so-called start-up faults are formed in the fabric. Such start-up faults show up if the inserted weft thread is not beat-up into the correct position so that an enlarged spacing occurs between neighboring weft threads. A series of such enlarged spacings resulting from improperly beat-up weft threads may show up as a stripe-type fabric fault if a certain limit value with regard to the spacings between weft threads is exceeded.

In order to keep the above mentioned faults which result from an insufficient rotational speed in the start-up phase of the loom, as small as possible, it has been customary heretofore to construct the loom drive in such a way that it reaches an adequate instantaneous rotational speed as quickly as possible so that only a minimal number of reed beats can take place while the loom does not yet operate at its rated r.p.m. In other words, the loom is supposed to reach a rotational speed of more than 96% of the desired or rated operational speed in a minimal length of time in order to avoid the start-up stripe faults in the fabric. Such stripe faults reduce the quality of the fabric. Practical experience has shown that, for example, at the time of the first beat of the reed an instantaneous speed of about 80% of the rated operational r.p.m. can be reached, while approximately after the third reed beat an instantaneous rotational speed of about 96% of the rated r.p.m. may be achieved. In order to obtain these percentage values it has been customary to use ever larger and stiffer, that is over-dimensioned, motors, while simultaneously reducing the weight, yet increasing the stiffness of the structure of the reed drive. However, this trend has its limitations due to the increase of the flywheel masses of the motor, of the clutch and of the power loom. Additionally, the lightweight structure of the reed drive has also its limitations due to economic considerations.

Similar problems occur in looms in which so-called free-flying weft thread insertion shuttles pass through the loom shed, for example, in the form of gripper shuttles. The starting velocity of the gripper shuttles must be so large that the shuttle passes safely through the loom shed and that it exits out of the loom shed within narrow time limits. In these instances the rated operational r.p.m. of the main shaft of the power loom is also to be achieved as early as possible after starting the loom, preferably before the first firing of a gripper shuttle. In this connection, German Patent (DE-PS) No. 1,535,525 describes a starting mechanism for power looms in which the flywheel used for the start-up of the power loom is driven prior to engaging the clutch between the flywheel and the main drive shaft of the loom in such a way that the flywheel rotates with a larger r.p.m. than is the normal r.p.m. during the weaving. In order to drive the flywheel prior to the start-up of the loom with a higher r.p.m. than the rated operational r.p.m., it is possible to provide a drive motor which runs with a constant r.p.m. and which drives the flywheel at the higher r.p.m. through a planetary gear which increases the r.p.m. of the motor to the higher r.p.m. of the flywheel.

The known apparatus according to German Patent (DE-PS) No. 1,535,525 requires an additional effort and expense due to the planetary gear. Additionally, the switch-over or starting operation of the power loom depends on the state of the clutch. Therefore, as long as the clutch is not engaged, the flywheel must be driven at the increased r.p.m. As a result, if the loom needs to be shut down due to the occurrence of a fault which causes an automatic shut-down of the loom and a disengagement of the clutch, the planetary gear will be driven and the flywheel will rotate at the increased r.p.m. during the entire time needed for removing the fault.

German Patent (DE-PS) No. 1,535,525 also discloses another possibility of accelerating the flywheel, namely by using an electric motor capable of running at two different speeds and which runs at the higher speed when the flywheel engaging clutch is disengaged. This type of structure is supposed to avoid the need for the above mentioned planetary gear drive and to permit constructing the wheels that are driven by the electromotor, so that these wheels provide the required flywheel mass. This type of arrangement according to the prior art is also subject to the above mentioned drawback that the operation at the increased r.p.m.

takes place for prolonged periods of time. Additionally, a free-wheeling device is required in order to avoid during the clutch engagement that the kinetic energy stored in the rapidly rotating flywheel is taken up by the electric motor in that instance when the motor rotates at its lower r.p.m. This free-wheeling device between the electric drive motor and the flywheel also involves an additional structural effort and expense which should be avoided.

German Patent Publication (DE-OS) No. 3,542,650 also relates to the problem involved in the start-up of power looms. In that reference it is also suggested to increase the r.p.m. of the electrical drive motor to a value above the rated operational r.p.m. while the clutch between the flywheel and the loom drive shaft is disengaged. Several possibilities are suggested to achieve this purpose, namely, how to adjust or control the increased r.p.m. Basically, the disclosure of German Patent Publication (DE-OS) No. 3,542,650 does not add anything of significance to the disclosure of the above mentioned German Patent (DE-PS) No. 1,535,525.

Another suggestion disclosed in German Patent Publication (DE-OS) No. 3,542,650 mentions the use of a frequency controlled electric motor as the drive for the loom. Such a frequency controlled electric motor can easily embody the electric motor according to German Patent (DE-PS) No. 1,535,525 which is to be able to run at one or the other of two r.p.m.s. Particular details in this respect are not mentioned in German Patent Publication (DE-OS) No. 3,542,650. Rather, the disclosure of this reference is limited exclusively to the control of the run-up and of the higher r.p.m. of the drive motor. Regarding the procedures or operations during the coupling of the loom to the drive motor running at a higher r.p.m. there is merely mentioned in connection with the r.p.m. diagram in the disclosure of German Patent Publication No. 3,542,650 a time section in which the loom runs up from standstill to its rated operational r.p.m., while the r.p.m. of the drive motor first drops from its increased r.p.m. to an r.p.m. below the rated operational r.p.m. of the loom, whereupon it rises again together with the r.p.m. of the loom until the rated operational r.p.m. is reached. It is also mentioned in said German Patent Publication that by selecting the higher idling r.p.m. sufficiently high, the r.p.m. reduction below the rated operational r.p.m. can be reduced or even avoided. However, this fact points out new problems because avoiding the r.p.m. reduction requires a substantial increase of the r.p.m. range and such an increase in turn calls for a higher power rating of the drive motor which in turn requires a higher effort and expense. This must be avoided. However, said German Patent Publication does not disclose how such problems can be avoided. The reference also does not mention anything regarding the possibility of using free wheeling devices as are disclosed in said German Patent (DE-PS) No. 1,535,525.

The above discussed prior art does not make any suggestion how, by simple means, the above mentioned time duration could be shortened and how, even with a slightly increased acceleration r.p.m., the undesired r.p.m. reduction caused by the engagement of the clutch can be avoided.

OBJECTS OF THE INVENTION

In view of the foregoing it is the aim of the invention to achieve the following objects singly or in combination:

to avoid the use of a planetary gear drive and the use of free wheeling devices in connection with the start-up of a power loom;

to reduce the time duration during which the drive motor runs with an increased r.p.m. for the acceleration of the flywheel;

to make sure that the required higher r.p.m. for the acceleration of the flywheel is reached in the shortest possible time; and to avoid the above damage to the fabric by assuring that the loom has the proper rated operational speed at the time when the reed executes its first beat.

SUMMARY OF THE INVENTION

The characterizing features of the invention are seen in that during the start-up of the power loom the drive motor is disconnected from its electrical power supply for that period of time during which the higher rotational speed of the flywheel mass adapts itself to the r.p.m. of the main loom drive shaft so that the power loom is started up exclusively with the mechanical energy stored in the flywheel mass. By temporarily disconnecting the electric drive motor from its electrical power supply so that it is neither driven at an increased r.p.m., nor with a reduced r.p.m., the use of mechanical free wheeling devices and the use of a planetary gear drive becomes unnecessary. This teaching for starting-up a power loom can be employed in connection with different types of electric drive motors capable of being operated at higher or lower rotational speeds. Frequency controlled electric motors are suitable for the present purpose and so are pole switchable electric motors or brushless d.c. motors.

An electrical motor having switchable poles provides a simple possibility of switching between two different r.p.m.s. Thus, the planetary gear drive may be avoided. However, the requirement that a free wheeling characteristic is available remains and so does the requirement that the operation of the pole switchable motor at an increased r.p.m. should be as short as possible. The invention satisfies these requirements by completely disconnecting the pole switchable motor from its power supply when the stored energy of the flywheel rotating at a higher r.p.m. is used for starting-up the drive shaft of the loom and by switching off the pole switchable motor when it accelerates the flywheel, well before the pole switchable motor reaches its full r.p.m. at the lower pole number. The r.p.m. ratios in a pole switchable motor are customarily 1:2 between neighboring pole numbers. However, the invention is based on the discovery that an increase of the motor r.p.m. to twice its rated operational r.p.m. is not necessary for charging up the flywheel mass prior to using the mechanical energy stored in the flywheel mass for starting up the power loom. Rather, it is sufficient to increase the r.p.m. only to about 15 to 20% above the rated operational speed. Thus, if according to the invention the control signal for switching the pole switchable motor to its increased r.p.m. is provided directly prior to the time when the power loom is to be started up, then the higher r.p.m. that is required or desired for the start-up of the power loom, is achieved within the shortest possible time because the r.p.m. increase does not need to reach twice the rated speed as stated above. Rather, the run-up of the pole switchable motor can be interrupted when the r.p.m. reaches a value corresponding to about 15 to 20% of the rated r.p.m. and at that time the flywheel can be coupled to the drive shaft of the loom while the pole switchable motor itself is disconnected from the power supply. The exact point of time for disconnecting the pole switchable motor from its power supply for interrupting the run-up can be monitored in any suitable way, for example a time delay based on experience can be used or a device for measuring the r.p.m. or rotational speed of the loom shaft may provide the required control signal. Adjustable time delay circuits for providing the required control signal may be used. In any event, the invention avoids a prolonged running of the drive motor at an increased r.p.m. during a time needed for removing of a fault in the operation of the loom. The coupling of the flywheel to the loom shaft may be synchronized with the interruption of the run-up of the pole switchable motor to its higher r.p.m. However, according to the invention the motor itself is not immediately switched back to its lower r.p.m., but rather it is completely disconnected temporarily from its electrical power supply and its windings are short-circuited for this intermediate time.

In all embodiments of the invention the adaptation of the r.p.m. of the flywheel to the r.p.m. of the loom drive shaft takes place during a transition time during which the loom shaft is accelerated with the energy stored in the flywheel. A special mechanical free wheeling device between motor and flywheel are thus no longer necessary. Only after a certain deceleration of the electrical motor has taken place, will the motor be reconnected to its power supply and switched to the lower r.p.m. for subsequently driving the loom at its rated operational r.p.m. or speed. The delay time or transition period is advantageously so selected that the connection between the three-phase power supply and the motor is accomplished briefly after the first beat of the reed. The time delay between disconnecting the motor from its power supply until reconnecting the motor to its power supply can be automatically determined in response to several different values. For example, the instantaneous r.p.m. or rotational speed of the flywheel mass or of the loom main drive shaft or the rotational angle of the loom shaft may be measured for producing a respective switching control signal with the required time delay. As mentioned, an experience time delay may be used for adjusting a conventional switch for the power supply of the electric motor. In this manner it is possible to bring the instantaneous rotational speed of the loom drive shaft in the shortest possible time to a value of more than 96% of the rated operational speed counted from the time when the accelerated flywheel has been coupled to the loom main drive shaft. Thus, the above mentioned stripe faults in the fabric are avoided because a sufficient beat of the loom reed is assured.

Other advantages of the invention are seen in that the present teaching may be employed in presently installed looms without any substantial additional investment. Further, a fully automatic operation may be accomplished with the present teaching, for example, by employing a microprocessor control. Such a microprocessor control can control the loom in such a way that it is switched off in response to a fault, and then prepared for the subsequent automatic start-up and run-up. The microprocessor control also can take over the disconnection of the motor from its power supply and its switching, as well as the operation of the clutch between the shafts and the flywheel after the fault has been removed. Thus, all controls or the control sequence can be performed automatically.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
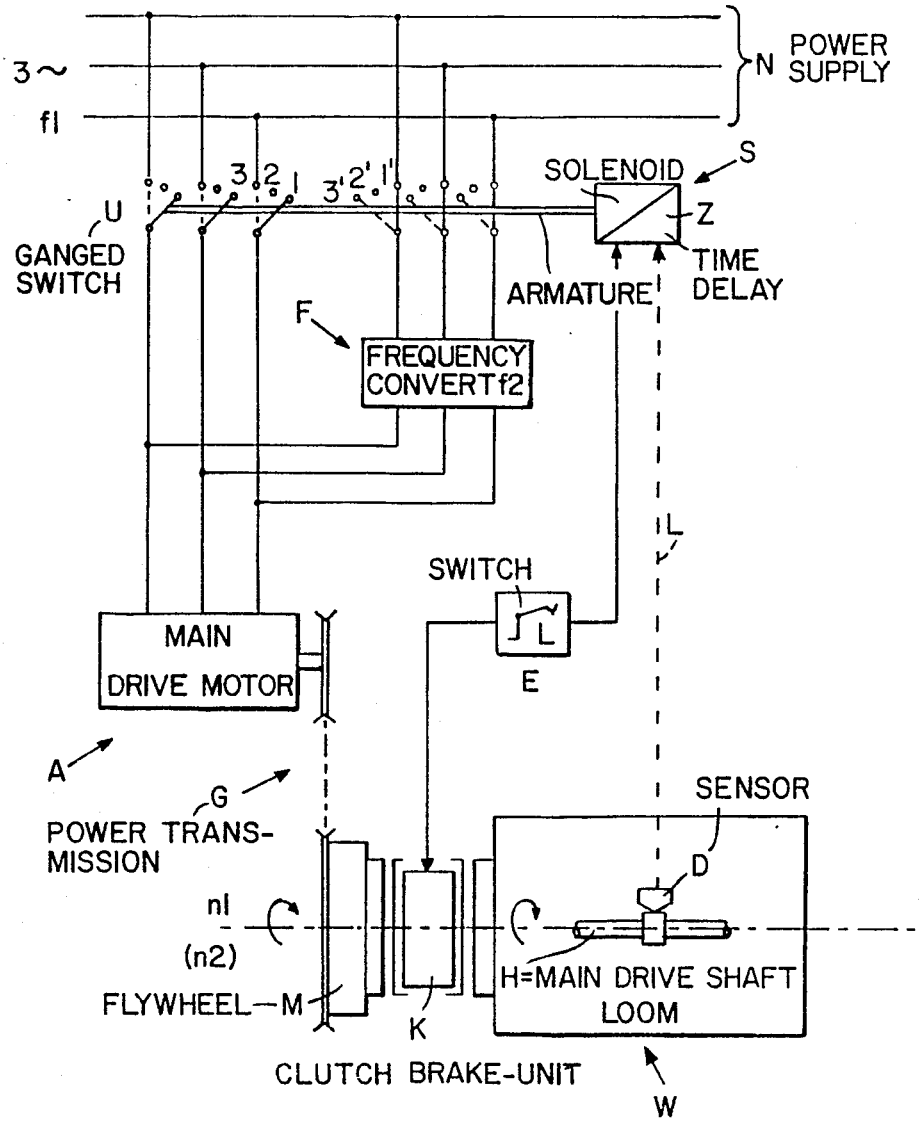
FIG. 1 is a block circuit diagram for the drive of a loom by means of a frequency controlled motor.

FIG. 1 shows a block circuit diagram of a first system for performing the present method of starting up a power loom W of which only the main drive shaft H is shown since all the other loom components are not necessary for understanding the invention. The shaft H is driven through an electrical motor A which is normally energized by a three-phase power supply N having a basic frequency f1. According to the invention the motor A is connectable and disconnectable from the N during particular time periods of a start-up sequence, by means of a change-over switch U which is operated by a solenoid S which in turn is responsive to a time delay circuit or device Z. The change-over switch U has a first ganged set of contacts 1, 2, and 3 and a second ganged set of contacts 1', 2', and 3'. Each contact in each set can cooperate with three terminals. Thus, in the shown full line position of the contacts, the drive motor A is connected to the power supply N through a frequency converter F having a frequency f2. In this first position the contacts 1, 2, and 3 which normally connect the motor A directly to the N are all disconnected from the power supply net. When the solenoid S, which operates the two sets of contacts simultaneously, moves the contacts to the intermediate positions respectively, the motor A is completely disconnected from the power supply N. When the solenoid S moves the ganged sets of contacts by another step the motor A is directly connected to the net N through the contacts 1, 2, and 3 and the frequency converter F is disconnected from the power supply net N.

The frequency converter F converts the frequency f1 of the net N to a higher frequency f2. Devices for this purpose are well known in the art. The second frequency f2 is adjustable at the frequency converter F.

In accordance with the above mentioned three switch positions of the contacts 1, 2, and 3, and 1', 2', 3', there are three operational phases. In the first phase I in which the motor A is energized through the frequency converter F, the motor operates at an increased r.p.m. above the rated operational r.p.m. of the loom shaft H. In this first phase I the motor A drives a flywheel M through a power transmission G such as a belt and pulley drive, to accelerate the flywheel M to said increased r.p.m. In this first phase I, the flywheel M is disconnected from the shaft H by disengaging the clutch brake unit K. In the second phase II an operator generates a control signal, for example, through a switch E which simultaneously causes the solenoid S to completely disconnect the motor A from its power supply and to simultaneously engage the clutch brake unit K for connecting the flywheel M to the shaft H. Simultaneously, a time delay may be started. In the third phase III which begins after said time delay, the solenoid switches the switch U so that the motor A is now directly energized by the net N at the lower frequency f1 so that the motor runs at its lower rated operational r.p.m. This third phase III begins when the instantaneous rotational speed of the flywheel M has decreased into the range of the rated operational r.p.m. of the shaft H.

The above described motor A with its power transmission G and the flywheel M as well as the clutch brake unit K are of conventional construction. When the motor A is directly connected to the net, the power supply to the motor has a frequency f1 so that the motor drives the flywheel M with an r.p.m. n1. This r.p.m. depends on the structural details of the motor, the power transmission, and so forth. These considerations will be taken into account to make sure that the rated operational r.p.m. of the shaft H and the r.p.m. n1 are equal to each other. On the other hand, when the motor A is energized through the frequency converter F with the frequency f2, the resulting r.p.m. for accelerating the flywheel M will be n2. Since the frequency f2 is higher than the frequency f1, the r.p.m. n2 will be higher than the r.p.m. n1. The above mentioned operator controlled switch E is provided for the start-up of the power loom W. When the operator closes the switch E the solenoid S and the brake clutch unit K are activated. A signal generator D, for example in the form of an r.p.m. sensor or rotational speed sensor, is provided to produce a signal for stopping the time delay Z which was started with the closing of the switch E. The dashed line indicates the supply of a signal from the sensor D to the time delay Z. Alternately, the sensor D may directly switch the solenoid S.

Figure 2:
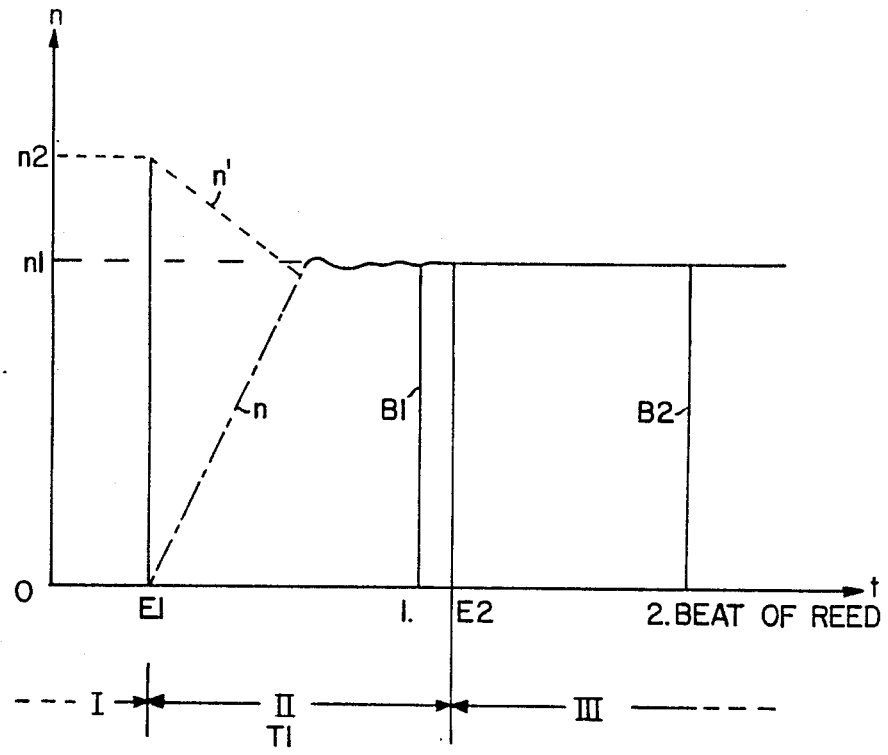
FIG. 2 is an r.p.m. characteristic as a function of time of a system as illustrated in FIG. 1.

For describing the operation of the present system let it be assumed that the loom has been shut off automatically, for example, due to a fault and that the entire system is in the operational first phase I as mentioned above. In that phase the shaft H of the loom W is disconnected from the flywheel M by the deactivation of the brake clutch unit K and thus the loom is also disconnected from the motor A and the shaft H is at standstill. The switch-over ganged switch U is in position 1, 1'. In this position the motor 1 is energized through the frequency converter F at the higher frequency f2. Thus, the flywheel M is accelerated with the higher r.p.m. n2 due to the higher frequency f2. FIG. 2 shows this first phase I in its left-hand portion. For starting the power loom W after a fault has been removed, the switch E is activated at the point of time E1 for initiating the second operational phase II. As a result of closing the switch E, the solenoid S drives the change-over switch U into the intermediate position 2,2' in which the motor A is completely disconnected from the power supply net. In other words, the motor is not energized directly, nor is it energized through the frequency converter F. During this phase II the energy stored in the flywheel M is exclusively effective. Simultaneously, with the operation of the switch E, the brake clutch unit K is activated and the flywheel M is connected or coupled to the loom shaft H. As shown in FIG. 2 during the second phase II the r.p.m. n' of the flywheel M decreases from its accelerated value n2 as indicated by the dashed line. Simultaneously, the r.p.m. n of the shaft H increases as indicated by the dash-dotted line. When the coupling is completed, the two r.p.m.s n and n' have equal values. Due to the initially higher accelerated r.p.m. n2 of the flywheel M, the equalization takes place approximately in the range of the rated operational r.p.m. n1, for example, only slightly below this value n1. As a result, the rotational speed of the power loom is already sufficiently high when the first beat B1 of the reed takes place so that the first weft thread is beat up practically with the full force and the above mentioned stripe faults are avoided in the fabric. As mentioned, during the second phase II having a duration T1 as determined by the time delay Z, only the mechanical energy stored in the flywheel M is effective.

The time delay T1 is so selected that preferably after the first beat of the reed the third phase III is initiated at a time E2. For this purpose the switch U is operated from position 2, 2' into position 3, 3', at this switch position the motor A is directly connected to its power supply net N. Thus, the flywheel M and the main shaft H are now driven by the rated operational r.p.m. n1. The second reed beat B2 now takes place with the full force.

The time delay T1 can be adjusted, for example, based on experience. Thus, when the switch E is closed for operating the solenoid S, the time delay member Z is also started simultaneously for controlling the solenoid after a predetermined time delay to move the switch U from position 2, 2' into position 3, 3'. Instead of using the time delay member Z, it is possible to provide the delayed signal by the sensor D which measures the instantaneous r.p.m. or rotational angle of the shaft H to provide a respective signal to the solenoid S as indicated by a dashed line L in FIG. 1 for switching the switch U from position 2, 2' to position 3, 3'. In this embodiment the delay time is determined by the time needed by the shaft H to reach a preselected r.p.m. In both instances, the operational phases I, II, and III correspond in FIG. 2 to the switch positions 1, 1'; 2, 2'; and 3, 3' of the switch U.

Figure 3:
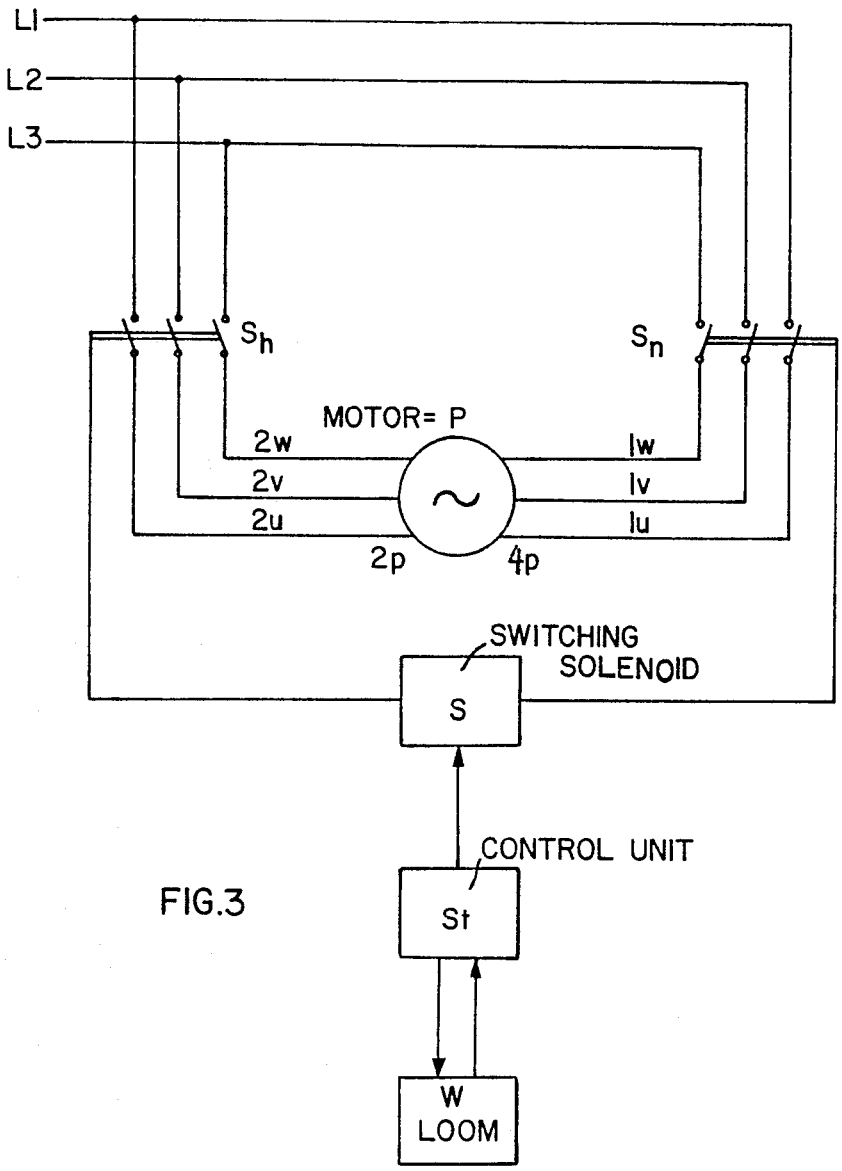
FIG. 3 illustrates a circuit diagram of a system according to the invention using a pole switchable motor for the start-up of a loom.
Figures 4A, 4B:
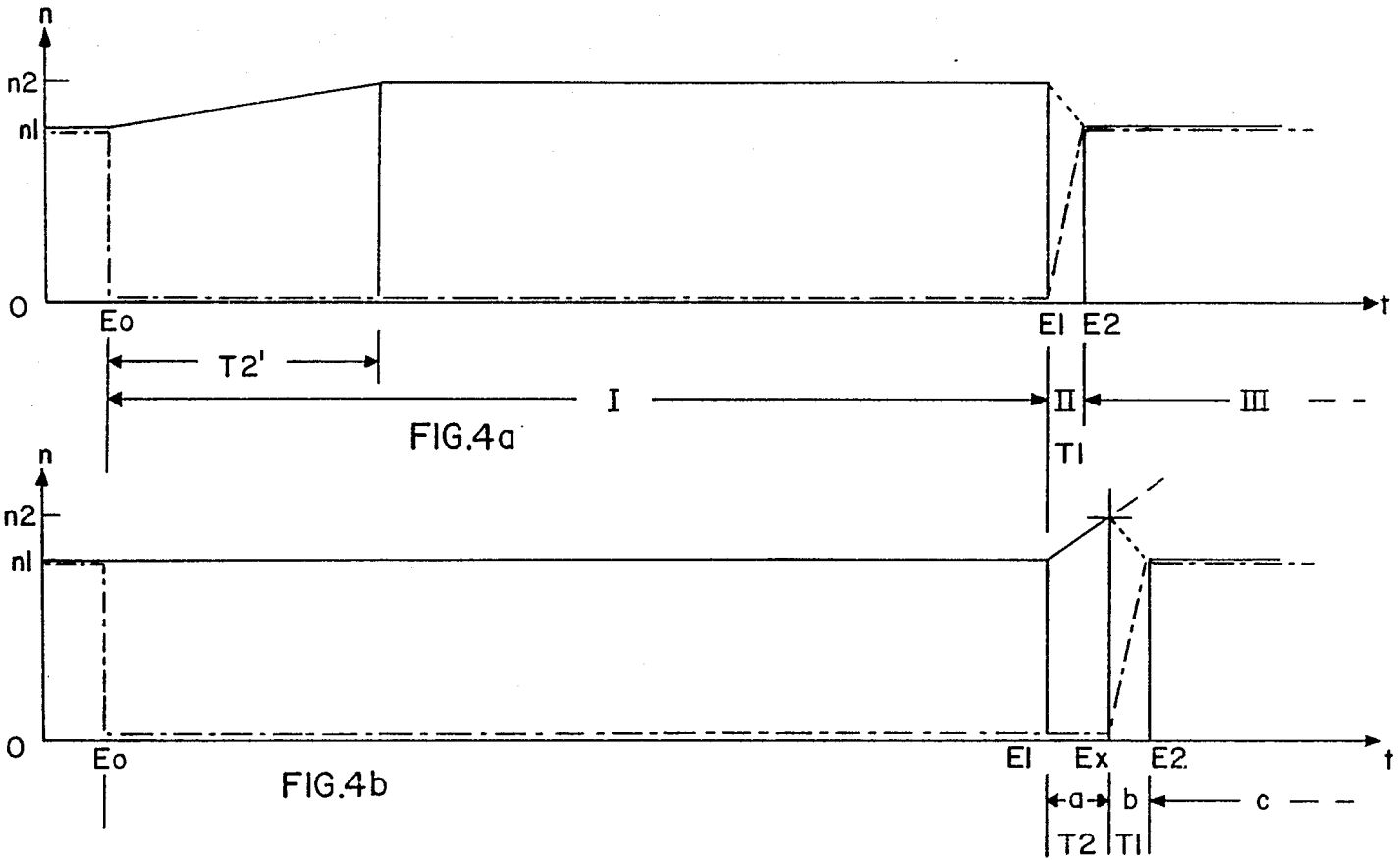
FIG. 4*a* shows an r.p.m. diagram for the start-up operation of the frequency controlled motor as shown in the system of FIG. 1.
FIG. 4*b* shows an r.p.m. diagram for the start-up operation of a pole switchable motor in the system of FIG. 3.

In the embodiment of FIG. 3, the motor P is a pole changeable motor which is capable of operating either in a two pole fashion 2*p* or in a four pole fashion 4*p*. The motor P drives the loom W and the flywheel M in the same manner as in FIG. 1. Pole changeable motors as such are known and can be operated in a number of different circuit arrangements. The switches Sh and Sn shown in FIG. 3 are arranged in the so-called Dahlander circuit. When the switch Sh is closed the motor P operates as a two pole 2*p* motor, while the switch Sn is open. The two pole motor has a higher r.p.m. When the switch Sh is open and the switch Sn is closed, the motor P operates as a four pole 4*p* motor at a lower r.p.m. Conductors 2*w*, 2*v*, and 2*u* connect the two pole motor P to the three phase net L1, L2, L3 through the switch Sh. Conductors 1*w*, 1*v*, 1*u* connect the four pole motor P to the three phase net through the switch Sn. The switches Sh and Sn are operated by a solenoid S controlled by a control unit St. The arrangement is such that normally the motor P operates in the 4*p* fashion at the lower r.p.m. corresponding to the rated operational speed n1. For the start-up the motor P is briefly switched to the two pole fashion. However, the time duration T2, please see FIG. 4*b*, is so selected that the motor P cannot reach its full r.p.m. n2. Rather, the time duration T2 ends when the motor P has reached an r.p.m. about 10 to 20% higher than the rated operational r.p.m. n1. At that time the rise of the motor r.p.m. is stopped and the motor is disconnected from the power supply altogether so that it is not energized at all at this time. When the motor P is disconnected altogether from the power supply, the flywheel M is coupled to the shaft H and the time period T1 takes place as shown in FIG. 4*b*, whereby the speed of the flywheel is reduced and the r.p.m. of the shaft H increased substantially in the same manner as described above. The time T1 is terminated when the substantial equalization of the two r.p.m.s has taken place at the end of the delay time T1 at which point the motor P is connected to the power supply through the switch Sn so that the motor operates as a four pole motor at the normal rated operational r.p.m. n1. The delay times T1 and T2 can be stored in a memory of the control unit St based on experience values or these delay times may be obtained by measuring respective values, for example, with the sensor D as mentioned above. The control unit St is also connected to the loom W for sensing the operational state of the loom and using respective values for the control operation. The following situations may, for example, be taken into account in the control operation.

EXAMPLE (a)

A fault occurred in that a first broken weft thread was fixed, but a second broken weft thread was not fixed. In this instance the start-up of the loom is prevented.

EXAMPLE (b)

Even if the operator should accidentally operate the switch E several times, an acceleration of the motor P to the full two pole r.p.m. is prevented.

EXAMPLE (c)

The loom cannot be started when a motor solenoid has not been energized.

These Examples (a), (b), and (c) are possible during the respective time periods as shown in FIG. 4*b*.

The above mentioned rated operational r.p.m. n1 is maintained even when a fault occurs because in that case only the loom W is decoupled or disconnected from its drive including the flywheel M.

FIGS. 4*a* and 4*b* show the short time duration T1 that is needed for bringing the shafts H from a standstill to the rated r.p.m. with the flywheel. The coupling of the flywheel rotating at the higher r.p.m. is also completed during this short time duration T1. Incidentally, the illustration in FIGS. 4*b* and 4*a*, as well as in FIG. 2 is not intended to be to any scale, but only for the illustration of the three operational phases I, II, and III according to the invention, and of the three operational phases a, b and c respectively.

FIG. 4*a* illustrates the operation of the present system equipped with a frequency controlled motor A as shown in FIG. 1. The rotational speeds n are shown as a function of time, whereby again n1 illustrates the rated operational r.p.m. or speed while n2 illustrates the increased r.p.m. of the accelerated flywheel. The full line indicates the r.p.m. characteristic of the frequency controlled motor, while the dash-dotted line illustrates the frequency characteristics of the loom. To the left of the point of time E0 the loom operates normally at the rated r.p.m. n1. At E0 a fault begins. Such a fault causes the automatic disconnection of the loom W from the drive motor A by disconnecting or deenergizing the brake clutch mechanism K. During the time durations I or operational phase I between E0 and E1, the fault in the loom is removed. At the same time, starting with E0, the motor A is switched to the higher r.p.m. by energizing the motor through the frequency converter F so that the motor reaches the higher r.p.m. n2 after a lapse of time T2'. The motor maintains this higher r.p.m. as long as it is energized through the frequency converter, namely until E1 at which time the fault has been removed. Now the operator activates the switch E, whereby the motor A is completely disconnected from the power supply net. Simultaneously, the brake clutch mechanism K is activated to connect the flywheel to the shaft during phase II or time period T1. The flywheel starts up the loom as described above and during this time the motor A remains disconnected from its power supply. At the time E2 the motor is reconnected to the power supply directly without the frequency converter to start phase III.

FIG. 4*b* has been described above and illustrates the several time phases for comparing the operation of the embodiment of FIG. 3 with that of FIG. 1. In FIG. 4*b* the fault also occurs at E0. However, the motor P remains at its normal r.p.m. n1 until point E1. At this time the motor is switched to its two pole operation for increasing the r.p.m. to the extent mentioned above. The predetermined time delay T2 makes sure that the motor reaches only the r.p.m. necessary for a proper acceleration of the flywheel and does not reach its complete two pole r.p.m. When the sufficient r.p.m. has been reached, the phase b for the duration T1 takes place as described. The phase b starts at Ex and when the time duration T1 has elapsed at point E2 normal operation is resumed in phase c at which the operational rated r.p.m. n1 is effective.

The important difference between the r.p.m. characteristics shown in FIGS. 4*a* and 4*b* is seen in that in connection with a frequency control drive motor A the time duration T2' as shown in FIG. 4*a* is relatively long for permitting the motor A to run up to the higher r.p.m. n2. Experience has shown that the duration T2' is longer by more than one order of magnitude than the duration T2 needed in connection with a pole changeable motor. Thus, it is recommended that a frequency controlled motor is not switched to the higher r.p.m. only at time E1, but rather to do so at the beginning right after a fault has occurred, please see FIG. 4*a*. Generally, even the frequency controlled motor needs less time for its run-up to the higher r.p.m. than is necessary for the fault removal, the time T2' is only a portion of the total time in the first phase I. However, in this manner the motor A would be running during the entire duration of phase I. Thus, the use of pole changeable motors requiring but a few seconds for the run-up might be preferable, depending on circumstances.

The present teaching of completely disconnecting the drive motor from its power supply temporarily during the start-up of the loom by the flywheel can be employed independently of the type of faults that needs to be removed and it is also very useful for the first start-up of the loom as well as for repeated start-ups after fault removals. The present method is also applicable, regardless of what caused the shut-down of the loom. It is also not important whether the motor runs at least part of the time at the higher r.p.m. during a fault removal or at the operational rated r.p.m. during the fault removal.

Although the invention has been described with reference to specific example embodiments, it will be appreciated, that it is intended to cover all modifications and equivalents within the scope of the appended claims.

What we claim is:

1. A method for starting a power loom having a main drive shaft with a rated operational r.p.m., an electric motor drive means, and a flywheel mass connected to said electric motor drive means and connectable to said main drive shaft, comprising the following steps:

(a) disconnecting said flywheel mass from said main drive shaft, (b) connecting said electric motor drive means to a power supply network for accelerating said flywheel mass to an accelerated flywheel mass having an r.p.m. higher than said rated drive shaft r.p.m., (c) reconnecting said accelerated flywheel mass to said main drive shaft in response to a first switching control signal, (d) using said first switching control signal for simultaneously and temporarily disconnecting said electric motor drive means from said power supply network so that during start-up of said main drive shaft said electric motor drive means is not energized, (e) providing a delayed second switching control signal when said flywheel r.p.m. approximates said rated drive shaft r.p.m., and (f) reconnecting said electric motor drive means to said power supply network in response to said second switching control signal, whereby said electric motor drive means are disconnected from said power supply network during a time duration when said flywheel mass accelerate said main drive shaft.

2. The method of claim 1, wherein the step of providing a delayed second switching control signal comprises the step of using an adjustable time delay device for generating said delayed second switching control signal when an adjusted time delay from said first switching control signal has elapsed.

3. The method of claim 1, further comprising the step of automatically switching said electric motor drive means to an r.p.m. higher than said rated drive shaft r.p.m., in response to disconnecting said main drive shaft from said electric motor drive means in case of a fault.

4. A method for starting loom having main drive shaft with a rated operational r.p.m., a pole changing electric motor drive means, and a flywheel mass connected to said electric motor drive means and connectable to said main drive shaft, comprising the following steps:

(a) disconnecting said flywheel mass from said main drive shaft, (b) connecting said electric motor drive means to a power supply network for accelerating said flywheel mass to an accelerated flywheel mass having an r.p.m. higher than said rated drive shaft r.p.m., (c) reconnecting said accelerated flywheel mass to said main drive shaft in response to a first switching control signal, (d) operating said pole changing electric motor drive means as an electric motor so that a first lower motor r.p.m. is within a range including said rated drive shaft r.p.m. and a second higher r.p.m. is above said rated drive shaft r.p.m., (e) providing a start signal for causing said electric motor to run-up to said second higher r.p.m., (f) using said first switching control signal for temporarily disconnecting said electric motor from said power supply network and interrupting said run-up of said electric motor, (g) coupling said flywheel mass to said main drive shaft while said electric motor is disconnected from said power supply network, (h) providing a delayed second switching control signal and switching said electric motor to said first lower motor r.p.m. corresponding approximately to said rated drive shaft r.p.m., and (i) reconnecting said electric motor to said power supply network for operation at said first lower motor r.p.m.

5. The method of claim 4, wherein the step of providing a delayed second switching control signal comprises the step of using an adjustable time delay device for generating said delayed second switching control signal when an adjusted time delay from said first switching control signal has elapsed.

6. A system for starting a power loom, comprising a loom drive shaft, electric motor drive means for driving said loom drive shaft, flywheel means for a run-up start of said loom drive shaft, brake and clutch means operatively interposed between said electric motor drive means and said loom drive shaft, an a.c. power supply network, a frequency converter, change-over switch means operatively arranged for providing a direct connection of said electric motor drive means to said a.c. power supply network or an indirect connection of said electric motor drive means through said frequency converter to said a.c. power supply network, said change-over switch means comprising three positions, a first end position providing said direct connection, an intermediate position disconnecting said electric motor drive means from said a.c. power supply network and a third end position providing said indirect connection, operator actuated switch means electrically connected to said change-over switch means for intentionally switching said change-over switch means from one of said end positions to said intermediate disconnecting position, and automatic operating means connected to said change-over switch means for automatically switching said change-over switch means from said intermediate disconnecting position to the other end position when a time delay has elapsed.

7. The system of claim 6, wherein said change-over switch means comprise a solenoid for operating said change-over switch means, said solenoid comprising time delay means for performing said time delay.

8. The system of claim 6, further comprising r.p.m. sensing means for sensing an r.p.m. of said loom drive shaft and providing an output signal, and means for supplying said output signal to said change-over switch means for operating said change-over switch means in response to said output signal representing a certian r.p.m. of said loom drive shaft.

9. The system of claim 6, further comprising means for coupling said change-over switch means to said brake and clutch means for operating said change-over switch means in response to activation and deactivation of said brake and clutch means.

10. A system for starting a power loom, comprising a loom drive shaft, an electric motor drive means for driving said loom drive shaft, flywheel means for a run-up start of said loom drive shaft, brake and clutch means operatively interposed between said electric motor drive and said loom drive shaft, an electric power supply network, said electric motor drive means having changeable poles for changing the r.p.m. of said electric motor drive means between a first lower motor r.p.m. and a second higher motor r.p.m. wherein said first lower r.p.m. corresponds to a rated drive shaft r.p.m. and said second higher motor r.p.m. is above said rated drive shaft r.p.m., change-over switch means for connecting said electric motor drive means to said electric power supply network with two poles for said second higher motor r.p.m. and with four poles for said first lower motor r.p.m., said change-over switch means having a first two pole connecting position, a second four pole connecting position and an intermediate position in which said electric motor drive means is completely disconnected from said electric power supply network, control means including an operator actuated switch operatively connected to said change-over switch means for intentionally switching said electric motor drive means to said electric power supply network through said two pole connecting position, and after a first time delay for automatically switching said change-over switch means to said intermediate position, and after a second time delay for further automatically switching said change-over switch means to said four pole connecting position.

11. The system of claim 10, wherein said change-over switch means comprise a solenoid for operating said change-over switch means, said solenoid comprising time delay means for performing said first and said second time delays.

12. The system of claim 10, further comprising r.p.m. sensing means for sensing an r.p.m. of said loom drive shaft and providing an output signal, and means for supplying said output signal to said change-over switch means for operating said change-over switch means in response to said output signal representing a certain r.p.m. of said drive shaft.

13. The system of claim 10, further comprising means for coupling said change-over switch means to said brake and clutch means for operating said change-over switch means in response to activation and deactivation of said brake and clutch means.

* * * * *